United States Patent [19]

McDougall et al.

[11] Patent Number: 4,799,971

[45] Date of Patent: Jan. 24, 1989

[54] TUBING FOR ENERGY ABSORBING STRUCTURES

[75] Inventors: Wallace R. McDougall; James C. Seastone, both of Shelby

[73] Assignee: Copperweld Corporation, Pittsburgh, Pa.

[21] Appl. No.: 53,946

[22] Filed: May 26, 1987

[51] Int. Cl.[4] ..... C21D 8/06

[52] U.S. Cl. ..... 148/12 B; 148/12 F; 228/231; 138/177

[58] Field of Search ..... 148/12 B, 12 F, 909, 148/328, 320; 428/586; 228/200, 231; 138/177, 171; 296/188

[56] References Cited

U.S. PATENT DOCUMENTS 4,282,047 8/1981 Yamagata et al. ..... 148/909

FOREIGN PATENT DOCUMENTS 55-97423 7/1980 Japan ..... 148/909

57-104623 6/1982 Japan ..... 148/909

OTHER PUBLICATIONS

*The Making, Shaping and Treating of Steel,* 9th Ed., pp. 1119–1120.

*Primary Examiner*—Deborah Yee

*Attorney, Agent, or Firm*—Walter J. Blenko, Jr.

[57] ABSTRACT

Tubing for energy absorbing structures such as automotive door beams: The tubing is heated, quenched, reheated and cold rolled to final diameter. The tubing may be of a ferrous alloy containing C—0.21 to 0.30; Mn—1.00 to 1.50; P—0.035 max.; S—0.040 max.; Si—0.15 to 0.35; Mo—0.08 to 0.25; Al—0.020 min.

6 Claims, No Drawings

TUBING FOR ENERGY ABSORBING STRUCTURES

This application relates to ferrous metal tubing having energy absorbing properties. More particularly, the application relates to tubing suited for use in energy absorbing structures such as automotive door beams.

A need presently exists for metal beams, which when placed in an automobile door, will provide significant resistance to crushing through application of a force from the outside of the car. Such metal beams are intended to protect passengers in the car against collision impacts upon doors. In order to comply with Federal Motor Vehicle Safety Standards, the side door of a passenger car may be required to sustain an average crush resistance of at least 2,250 pounds within six inches of deformation, an average crush resistance of at least 3,500 pounds within twelve inches of deformation, and a peak crush resistance of at least 7,000 pounds (or two times the vehicle curb weight, if less) within 18 inches of deformation.

We have invented new and useful improvements in ferrous metal beams suitable for automotive door beams. We provide tubing for energy absorbing structures by forming flat ferrous metal into a cylindrical shape, welding the edges of the metal to form a tube, heating the tube to an elevated temperature, quenching the heated tube, reheating the tube to another elevated temperature, allowing the heated tube to air cool and finally cold rolling the tube in a sizing mill. We first heat the tube to a temperature above the $A_{c3}$ temperature and subsequently reheat the tube to a temperature below the $A_{c1}$ temperature. We prefer to heat the tube in first instance to a temperature in excess of about 1750° F. and to reheat the tube after quenching to a temperature below about 1200° F. We further prefer to make a reduction in diameter in the sizing mill in the range of about 1 to 1 ½ percent. We may manufacture tubing from a ferrous comprising

| | % |
|---|---|
| carbon | 0.21 to 0.30 |
| manganese | 1.00 to 1.50 |
| phosphorus | 0.035 max. |
| sulfur | 0.040 max. |
| silicon | 0.15 to 0.35 |
| molybdenum | 0.08 to 0.25 |
| aluminum | 0.020 min. |

More desirably, we employ an alloy having the following composition:

| | % |
|---|---|
| carbon | 0.24 to 0.30 |
| manganese | 1.10 to 1.50 |
| phosphorus | 0.025 max. |
| sulfur | 0.020 max. |
| silicon | 0.15 to 0.35 |
| molybdenum | 0.08 to 0.15 |
| aluminum | 0.020 min. |
| balance | iron and impurities in usual amounts. |

We preferably employ an alloy having the following composition:

| | % |
|---|---|
| carbon | 0.25 to 0.29 |
| manganese | 1.20 to 1.50 |
| phosphorus | 0.015 max. |
| sulfur | 0.015 max. |
| silicon | 0.15 to 0.35 |
| molybdenum | 0.18 to 0.15 |
| aluminum | 0.020 min |
| balance | iron and impurities in ordinary amounts. |

We prefer to provide a ferrous alloy which is welded and cold-reduced and is characterized by an ultimate tensile strength of at least about 140,000 psi, by an elongation between yield and failure of at least about 13% in two inches on a full section specimen, and by a ratio of yield strength to tensile strength not exceeding about 0.90. Preferably, we provide a ratio of yield strength to tensile strength of about 0.85.

We provide a ferrous metal strip made from an alloy of our specification. The strip is then formed to a cylindrical shape in a tube mill and is butt-welded to form a tube which is larger than final size. The welded tube is then heated to above the $A_{c3}$ temperature, preferably to about 1750°. The heated tube is quenched in a ring water quench and, after cooling, is reheated in a continuous roller hearth furnace to a temperature below the $A_{c1}$ temperature. Thereafter, the tube is allowed to air cool and is cold rolled for reduction in a sizing mill in which the outside diameter is reduced to about 1 to 1 ½%.

The invention makes possible the production of automotive door guard beams which combine an acceptably low cost with adequate strength and toughness to resist door crushing forces by yielding of the metal without actual failure of the beam until there is significant deformation.

While we have described certain present preferred embodiments of our invention, it is to be understood that our invention is not limited thereto and may be otherwise variously practiced within the scope of the following claims.

We claim:

1. The method of manufacturing tubing for use in energy absorbing structures which comprises forming flat ferrous metal into a tube which has a greater diameter than that of the finished tube, welding the edges of the tube, heating the tube to a temperature above the $A_{c3}$ temperature, quenching the heated tube, reheating the tube to a temperature below the $A_{c1}$ temperature, allowing the heated tube to air cool, and cold rolling the tube in a sizing mill to final diameter.

2. The method of claim 1 in which the tube is first heated to a temperature in excess of about 1750° F. and is reheated to a temperature below about 1200° F.

3. The method of claim 1 in which the reduction in diameter in the sizing mill is in the range of about 1 to 1 ½%.

4. The method of manufacturing tubing for use in energy absorbing structures from a ferrous alloy comprising:

| | % |
|---|---|
| carbon | 0.21 to 0.30 |
| manganese | 1.00 to 1.50 |
| phosphorus | 0.035 max. |
| sulfur | 0.040 max. |

-continued

| | % |
|---|---|
| silicon | 0.15 to 0.35 |
| molybdenum | 0.08 to 0.25 |
| aluminum | 0.020 min. |

comprising forming strip of the alloy into a welded tube having a greater than finished diameter, heating the tube to a temperature above the $A_{c3}$ temperature, quenching the heated tube, reheating the tube to a temperature below the $A_{c1}$ temperature allowing the reheated tube to air cool, and cold reducing the tube to final diameter.

5. The method of claim 4 in which the alloy has the composition:

| | % |
|---|---|
| carbon | 0.24 to 0.30 |
| manganese | 1.10 to 1.50 |

-continued

| | % |
|---|---|
| phosphorus | 0.025 max. |
| sulfur | 0.020 max. |
| silicon | 0.15 to 0.35 |
| molybdenum | 0.08 to 0.15 |
| aluminum | 0.020 min. |
| balance | iron and impurities in usual amounts. |

6. The method of claim 4 in which the alloy has the composition:

| | % |
|---|---|
| carbon | 0.25 to 0.29 |
| manganese | 1.20 to 1.50 |
| phosphorus | 0.015 max. |
| sulfur | 0.015 max. |
| silicon | 0.15 to 0.35 |
| molybdenum | 0.18 to 0.15 |
| aluminum | 0.020 min |
| balance | iron and impurities in ordinary amounts. |

* * * * *